US005356145A

United States Patent [19]

Verschoor

[11] Patent Number: 5,356,145

[45] Date of Patent: Oct. 18, 1994

[54] CARD SHUFFLER

[75] Inventor: Oetze A. Verschoor, Mierlo-Hout, Netherlands

[73] Assignee: Nationale Stichting tot Exploitatie van Casinospelen in Nederland, Hoofddorp, Netherlands

[21] Appl. No.: 184,441

[22] Filed: Jan. 21, 1994

[30] Foreign Application Priority Data

Oct. 13, 1993 [NL] Netherlands ..... 9301771

[51] Int. Cl.[5] ..... A63F 1/12

[52] U.S. Cl. ..... 273/149 R

[58] Field of Search ..... 273/149 R

[56] References Cited

U.S. PATENT DOCUMENTS

| | | | |
|---|---|---|---|
| 4,186,464 | 2/1980 | Sandoy | 273/149 R |
| 4,310,160 | 1/1982 | Willette et al. | 273/149 R |
| 4,497,488 | 2/1985 | Plevyak et al. | 273/149 R |
| 4,512,580 | 4/1985 | Matviak | 273/149 R |
| 4,513,969 | 4/1985 | Samsel, Jr. | 273/149 R |
| 4,586,712 | 5/1986 | Lorber et al. | 273/149 R |
| 4,659,082 | 4/1987 | Greenberg | 273/149 R |
| 4,770,421 | 9/1988 | Hoffman | 273/149 R |
| 4,807,884 | 2/1989 | Breeding | 273/149 R |
| 4,832,342 | 5/1989 | Plevyak et al. | 273/149 R |
| 4,969,648 | 11/1990 | Hollinger et al. | 273/149 R |
| 5,000,453 | 3/1991 | Stevens et al. | 273/140 R |
| 5,096,197 | 3/1992 | Embury | 273/149 R |
| 5,114,153 | 5/1992 | Rosenwinkel et al. | 273/149 R |
| 5,121,921 | 6/1992 | Friedman et al. | 273/149 R |
| 5,199,710 | 4/1993 | Lamle | 273/149 R |

FOREIGN PATENT DOCUMENTS

| | | | |
|---|---|---|---|
| 0310516 | 5/1991 | European Pat. Off. | 273/149 R |
| 2252764 | 8/1992 | United Kingdom | 273/149 R |
| 2252916 | 8/1992 | United Kingdom | 273/149 R |
| 91/08030 | 6/1991 | World Int. Prop. O. | 273/149 R |
| 91/15278 | 10/1991 | World Int. Prop. O. | 273/149 R |

*Primary Examiner*—Benjamin H. Layno

*Attorney, Agent, or Firm*—Wegner, Cantor, Mueller & Player

[57] ABSTRACT

The invention relates to a device for shuffling playing cards. The device has two shuffling card compartments which can each be placed in a first position and in a second position, and a delivery compartment; gripping rollers carry the playing cards from the shuffling compartment located in the first position to the shuffling compartment located in the second position. Gripping rollers also carry the playing cards from the card compartment located in the first position to the delivery compartment. A microprocessor activates the gripping rollers as determined by an algorithm. Motor driven discs feed the playing cards for shuffling to one of the shuffling compartments. The shuffling operations to be performed by the dealer are time-consuming, which is all the more important as the game has to be stopped during shuffling, so that a relatively large part of the available playing time at a gaming table has to be spent on shuffling, which of course has an adverse affect on the obtainable turnover at the table. In preference the shuffling device comprises a plateau where both shuffling compartments are mounted on. The plateau is rotatable on a vertical shaft for exchanging the position of both shuffling compartments.

16 Claims, 7 Drawing Sheets

CARD SHUFFLER

The present invention relates to a device for shuffling playing cards.

Such devices are known, among others from US-A-5000453.

Other card shufflers are described in US-A-4513969, US-A-4659082 and US-A-4770421.

All these machines forming part of the prior art have very complicated constructions, making them expensive, prone to breakdown and difficult of access for service and repair.

The object of the present invention is to provide such a machine of considerably simpler construction, thus avoiding the drawbacks associated with a complicated construction.

It is further of the greatest importance that the shuffling process takes place with good quality. This is after all necessary to avoid cheating at the game by card-counting or other techniques used by practiced players. A good quality of shuffling is moreover conducive to the fairness of the game.

It should be noted herein that an important application of the card shuffler according to the present invention lies in the use for the game of "Black Jack". In this game, mostly played in casinos and similar establishments, it is important that a stock of shuffled cards is always available, which cards are taken and brought into the game by the dealer dependent on the progress of the game.

In the case of manual shuffling a quantity of cards, for instance six decks, are shuffled by the dealer before the start of the game, whereafter the game commences. When a part of the total number of cards in the game has been dealt by the dealer, the game is stopped, the cards are collected and reshuffled, whereafter a cutting card is placed into the stack of shuffled cards by a player and the game is resumed until the shuffled cards have been used up to the cutting card.

The shuffling operations to be performed by the dealer are time-consuming, which is all the more important as the game has to be stopped during shuffling, so that a relatively large part of the available playing time at a gaming table has to be spent on shuffling, which of course has an adverse affect on the obtainable turnover at the table. The use of a cutting card moreover results in only a part, usually about half, of the number of available cards being used.

The use of a machine shuffler avoids this drawback; the shuffler carries out a constant shuffling process, wherein this is adapted such that there is always a supply of shuffled cards available to the dealer. The used cards can be taken up continuously into the shuffling process, so that the shuffling process can be performed continuously during play. The necessity to interrupt the game for the shuffling process is thus removed. Through the continuous use of the cards the use of a cutting card moreover becomes unnecessary, so that the whole quantity of cards can be used.

All these objects are achieved by a device for shuffling playing cards, comprising: two shuffling card compartments which can each be placed in a first position and in a second position; a delivery compartment; transporting means for carrying the playing cards from the shuffling compartment located in the first position to the shuffling compartment located in the second position; discharge means for carrying playing cards from the card compartment located in the first position to the delivery compartment; control means for normally activating the transporting means and for otherwise activating the discharge means as determined by algorithm; feed means for feeding the playing cards for shuffling to one of the shuffling compartments.

The shuffling process applied in this device achieves a high quality of shuffling; even for a practiced player it is not possible to predict which card is likely to come into the game. This enhances the fairness of the game to be played with the shuffled cards.

It will be apparent that after a period of time the shuffling compartment located in the first position will be emptied by the transporting means and the discharge means. It is of course possible to transfer the cards available in the card compartment present in the second position to the card compartment located in the first position, but according to an attractive preferred embodiment the device comprises means for exchanging the position of both shuffling compartments.

It will be apparent that this results in an exceptionally attractive construction.

According to another preferred embodiment the feed means comprise a feed compartment for receiving the playing cards for shuffling in addition to means for carrying playing cards from the feed compartment to the card compartment located in the second position.

These steps make it possible to place played cards into the feed compartment so that the shuffling compartment can be supplemented from the feed compartment.

According to another preferred embodiment the control means are adapted for activating the feed means simultaneously with the activation of the discharge means for at least a part of the time of use.

This step makes it possible to hold as constant as possible the number of cards taking part in the shuffling process; when a card is removed from the shuffling process and supplied to the delivery compartment, a new card is now automatically added to the shuffling process from the feed compartment.

Other preferred embodiments will be found in the remaining sub-claims.

The device according to the present invention will subsequently be elucidated with reference to the annexed drawings, in which.

Figure 1:
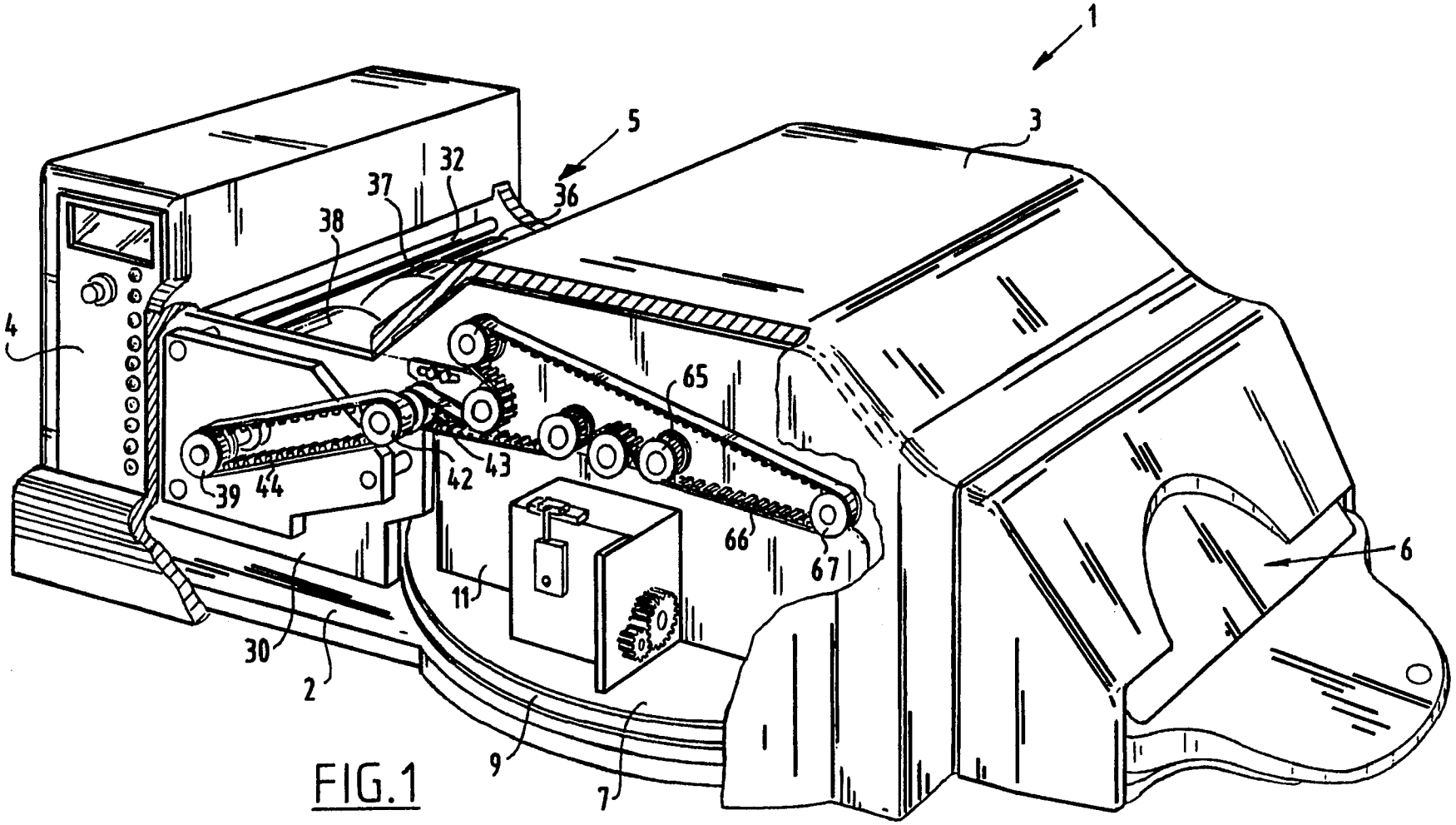
FIG. 1 shows a partly broken away perspective view of a card shuffler according to the invention.

The shuffling device 1 shown in FIGS. 1, 2, 3, 4 and 5 comprises a base plate 2 on which is placed the shuffling mechanism, which shuffling mechanism is closed off by a cover 3. Arranged in the cover is a control panel 4 for operating the shuffler and for indicating the operational situation. Further arranged in the cover are an opening 5 through which the cards for shuffling are fed to the shuffling mechanism and a take-off opening 6 through which the shuffled cards can be removed.

The shuffling mechanism will now be elucidated with reference to FIGS. 1, 2, 3, 4 and 5.

A turntable 7 is arranged on base plate 2 for rotation on a vertical shaft. Further arranged on base plate 2 is a turntable electric motor 8 which is provided on its output shaft with a pinion around which is trained a belt 9. The belt 9 is likewise trained about the turntable and fixedly attached thereto by means of a clamp 10.

To the turntable are fixed two walls 11, 12 extending in lengthwise direction and mutually connected in the middle by a connecting wall 13. At the ends the longitudinal walls 11, 12 are mutually joined by the respective end walls 14, 15. Situated between the walls 11, 12, 13 and 14 is a first shuffling card compartment 16 and between the walls 11, 12, 13 and 15 is a second shuffling card compartment 17. As a result of it being possible to rotate the turntable, both the first shuffling compartment 16 and the second shuffling compartment 17 can assume a first and a second position.

On the underside each of the shuffling compartments 16, 17 is closed by a respective base plate 19, 18. Guides 20 provided with elongate openings are arranged under the base plates. Sleeves 22 are arranged guidably in the openings 21 arranged in the relevant guides 20. The sleeves 22 are each mounted on a shaft 23 received in a bearing bush 24. Bearing bushes 24 are each connected to a drive shaft 26 by means of a lever 25, wherein each of the drive shafts 26 extends only over half the length of the partition wall 13.

Both drive shafts 26 otherwise extend mutually in line and are rotatably mounted in the partition wall 13. For each of the drive shafts 26 is arranged a drive mechanism 27 which is formed by an electric motor 28 which drives the associated drive shaft 26 by means of a tooth wheel and worm wheel transmission 29.

The device further comprises on the feed side two side walls 30, 31 which are each fixed to base plate 2 and are mutually joined by a number of cross connections 32. Both side walls 30, 31 are herein also connected by an end wall 33 which also functions as wall of a space in which is accommodated a part of the electronic control circuit for the device and as cooling plate for the components forming part thereof.

Both side walls 30, 31 are moreover connected by a rotatable shaft 34 on which are placed discs 35.

Placed against side wall 31 is an electric motor 36, on the output shaft of which is arranged a drive disc 37, the upper part of which protrudes slightly above the discs 35 and the cross connection located furthest to the side of wall 33. This cross connection 32, the drive disc 37 and the discs 35 together form the bottom of the feed compartment, the walls of which are otherwise formed by the cover 3. Although it is possible to not drive shaft 34, this shaft 34 is preferably driven by a cord (not shown in the drawing) between a pulley arranged on the carrier disc and a freewheel coupling fixed on the shaft 34.

Arranged against the inside of wall 30 is an electric motor 38, the output shaft of which extends through the wall 30. A belt pulley 39 provided with teeth is arranged on the output shaft. Both walls 30, 31 are further connected by a shaft 40 on which are arranged a roller 41 and, outside the wall 30, two pulleys 42, 43. The pulleys 39, 42 are mutually Joined by a toothed belt 44.

A folding sub-frame 45 is arranged above turntable 7, this above the level of the longitudinal walls 11, 12, the connecting wall 13 and both end walls 14, 15. The folding sub-frame is formed by two side plates 46, 47 connected by a number of cross connections 48.

The sub-frame 45 is further connected hingedly to both side walls 30, 31 by means of shaft stubs 49 arranged on each of the side walls 30, 31 and recesses 50 arranged in both side plates 46, 47.

On the distal end of sub-frame 45 a support 51 is arranged between both side plates 46, 47 which is connected by means of rods 52 to a transverse connection 48. A carrier roller 100 is mounted in the support. The rods 52 essentially form only a stop for the downward movement of support 51. The latter is supported as a whole on the rod 54.

When the sub-frame 45 is folded downward the carrier roller 100 is pressed against the driven carrier roller 41. In order to exert a downward directed force, support 51 is provided with springs 53 which are wound round a rod 54 which connects both side plates 46, 47 and which also applies a guiding function for support 51.

Arranged in similar manner on the other side of cross connection 48 is a support 55 in which is mounted a carrier roller 56. This carrier roller 56 is also spring-mounted in sub-frame 45 as a result of arranged springs 57 which are wound round a shaft 58.

Finally, a last carrier roller 61 is arranged between both side plates 46, 47 which is likewise spring-mounted in the sub-frame by means of a support 62.

An electric motor 60 is further arranged hingedly in the sub-frame such that the electric motor is movable to a slight extent in vertical direction. A drive roller 59 is arranged on the output shaft of electric motor 60.

In the space enclosed between the sub-frame in its downward folded state and the rotatable part fixed to the turntable 7 further extend two carrier rollers 63, 64 which are mounted on shafts extending between the side plates 30, 31.

These carrier rollers 63, 64 are driven in rotation together with the above described carrier roller 41 by belt pulleys 65, 67 respectively 43 which are fixed to the associated shafts and around which a toothed belt 66 is tensioned.

The description will now focus on the construction of discharge means for the shuffled playing cards. This description is given with reference to FIGS. 6 and 7.

Figure 6:
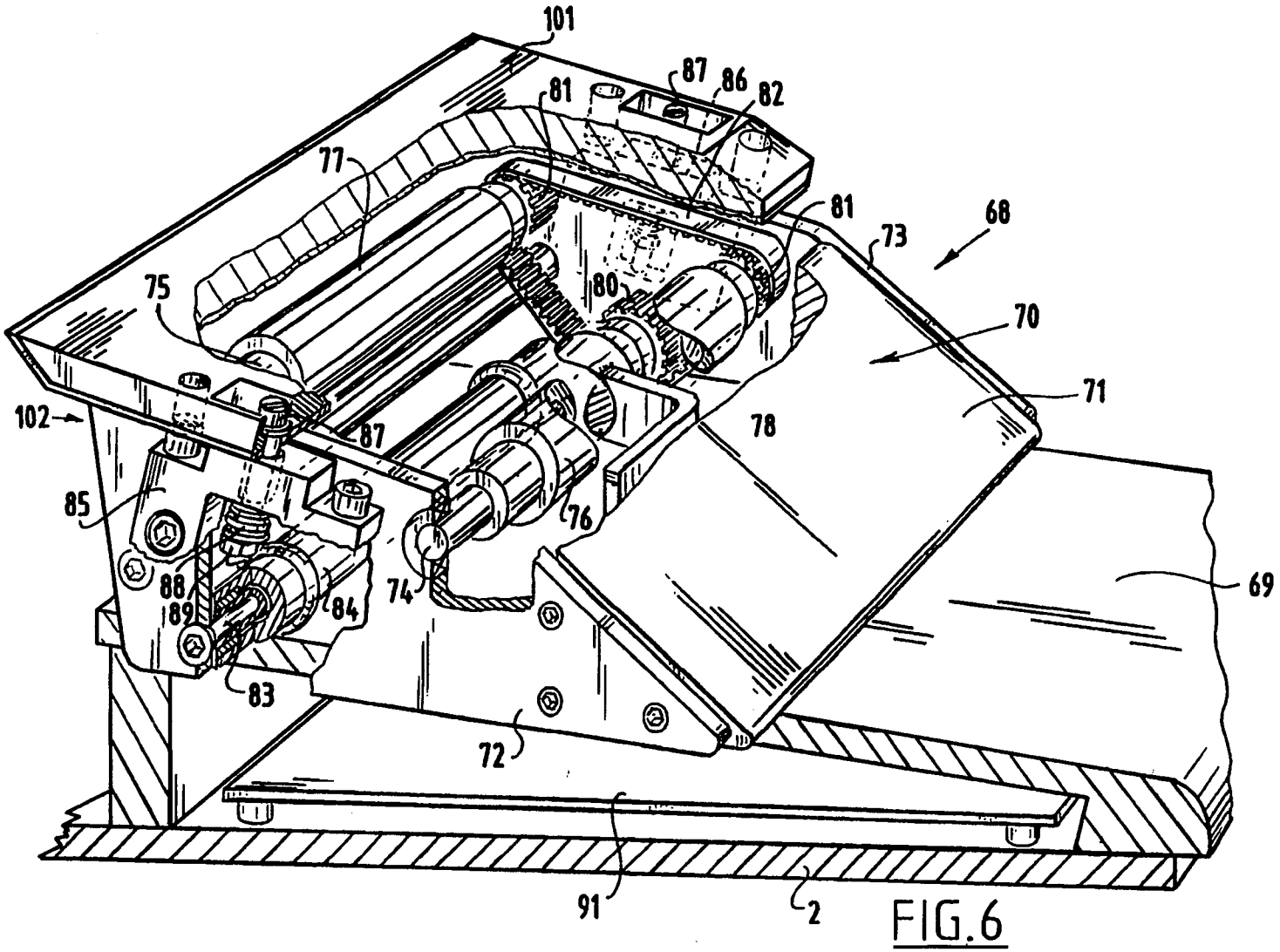
FIG. 6 is a partly broken away detail view of the take-off shoe of the card shuffler according to the invention.
Figure 7:
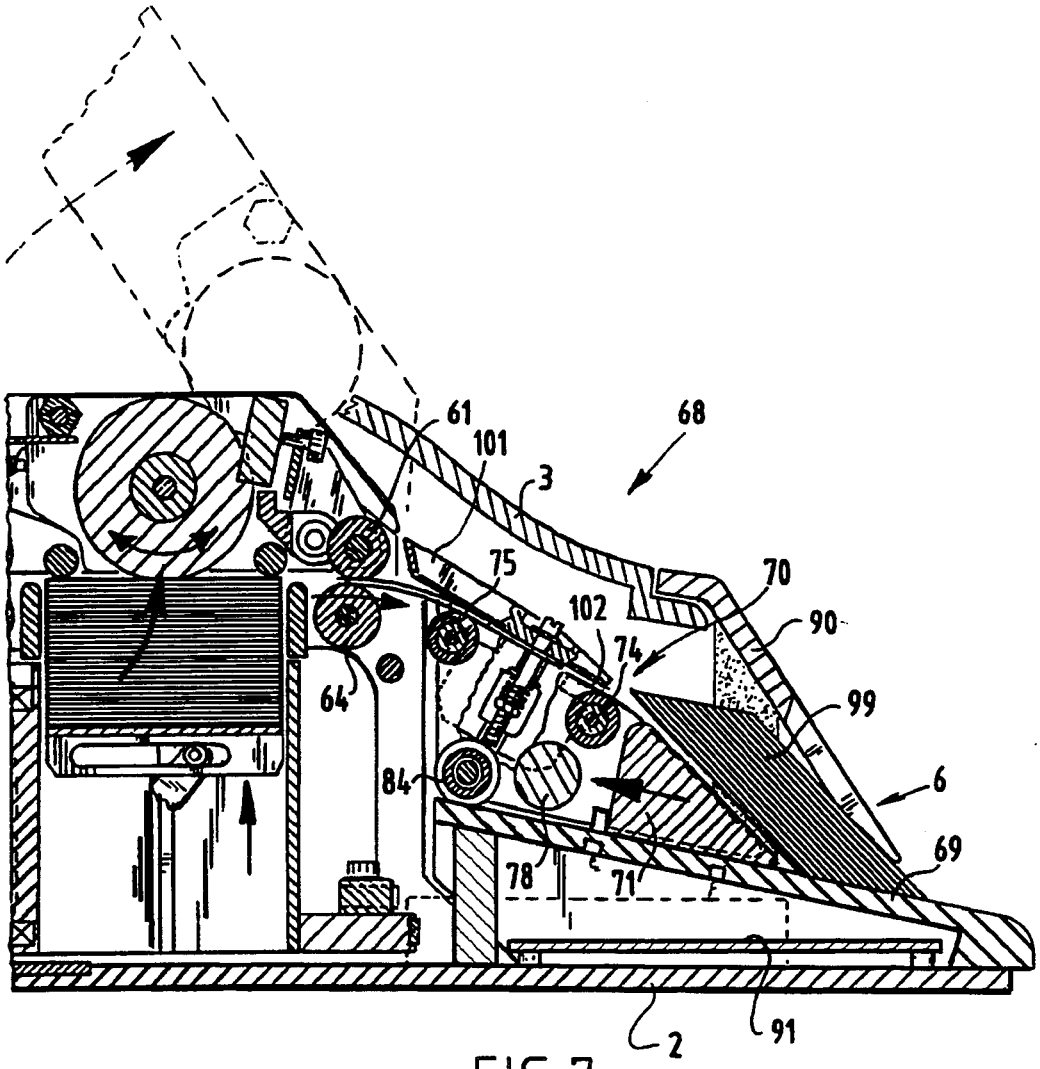
FIG. 7 is a sectional view of the shoe depicted in FIG. 7.

As can be seen in FIGS. 6 and 7, the discharge device 68, also known as the "shoe" in gaming jargon, is placed above a part of base plate 2. Discharge device 68 is likewise covered by a part of the cover 3.

In essence the discharge device 68 comprises an obliquely disposed plate 69 fixedly connected to the base plate 2. Arranged on this oblique plate 69 is a carriage 70 which is formed by a prismatic body 71 provided on either side with side plates 72, 73. Fixed on the upper side between the plates are two shafts 74, 75 to which are attached carrier rollers 76, 77 respectively.

Further arranged in the space between the two side plates 72, 73 is an electric motor 78, on the output shaft of which is arranged a belt pulley 80. Belt pulleys 81 are arranged on each of the shafts 74, 75. A toothed belt 82 is trained around each of the pulleys 81, 80. When the electric motor 78 rotates, the carrier rollers 76, 77 are thus driven in rotation.

Finally, a shaft 83 is arranged on the underside between both plates 72, 73, on which shaft a free-rotating roller 84 is fixed. The dimensioning of the various parts is such that the thus formed construction can move easily over the path formed by the inclining plate 69, wherein the rear part of the construction rests via the roller 84.

A guide plate 101 is arranged on the upper part of both side plates 72, 73, wherein between guide plate 101 and rollers 77 and 76 is formed a guide channel 102. Arranged on the outside of plates 72 and 73 are brackets 85, 86 respectively which function as carrier for guide plate 101. To this end screws 87 extend through openings arranged for this purpose in guide plate 101 and brackets 85 respectively 86, wherein on the underside of screws 87 are arranged springs 88 which are secured by nuts 89. The guide plate 101 is thus pressed firmly against brackets 85, 86 but can move upward to a small extent under the influence of a playing card.

On the front side, as shown in FIG. 7, the discharge device is closed off by a front wall 90 into which is recessed the take-off opening 6.

At diverse locations in the device detection members are arranged for detecting the presence of playing cards. A detection unit (not shown in the drawing) is thus arranged for detecting the presence of cards in the feed compartment and a detection unit is arranged in the shoe to determine how many cards are situated in the shoe.

In addition the non-driven carrier rollers arranged in the sub-frame are provided with a detector to detect whether more than one card at a time is being transported, which would disrupt normal operation.

The detection devices are all connected by means of wire connections (not drawn) to a control means formed by a microprocessor and the associated input and output circuits.

Figure 2:
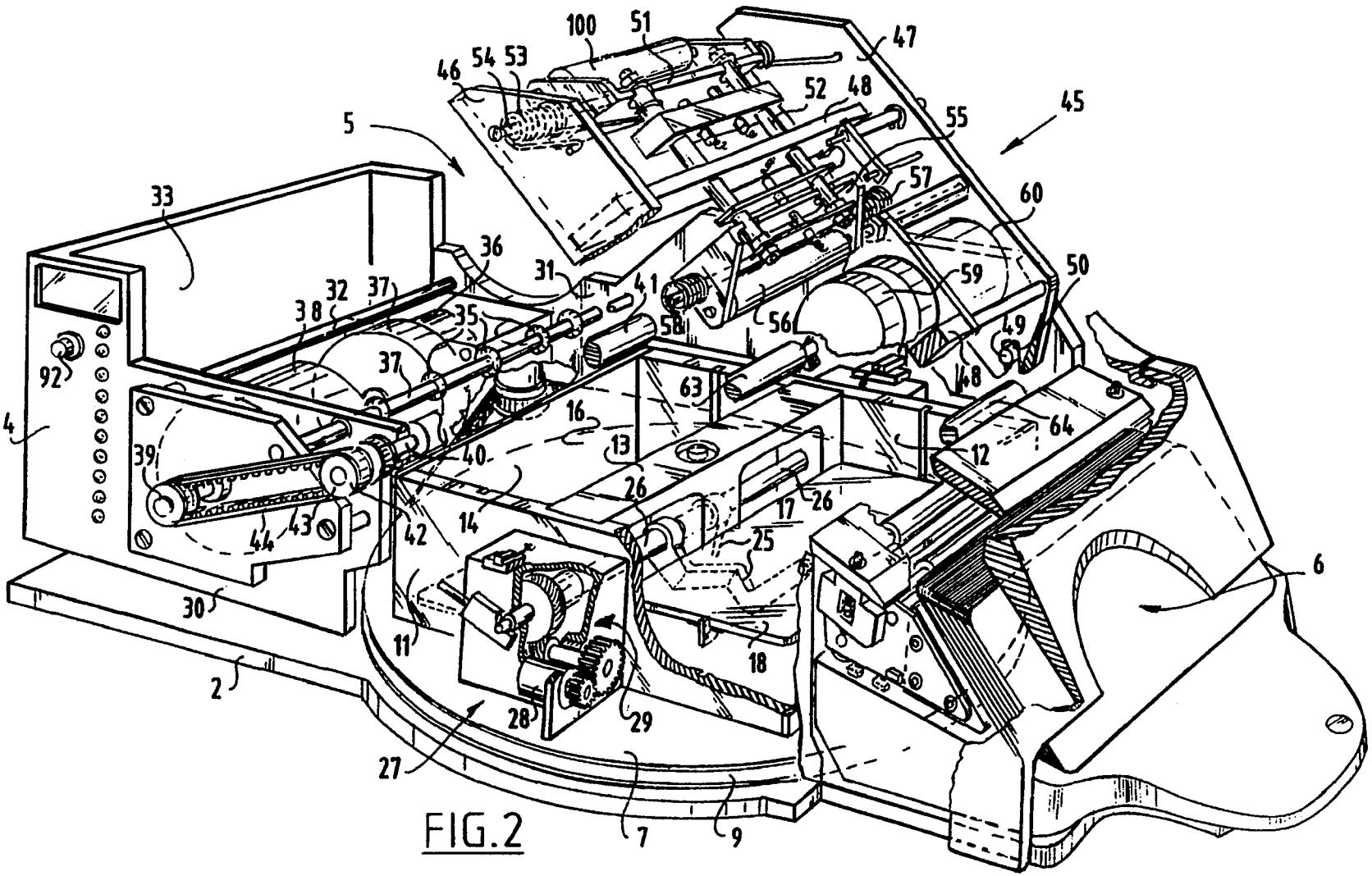
FIG. 2 is a partly broken away perspective view of the card shuffler depicted in FIG. 1, wherein the cover is removed.
Figure 3:
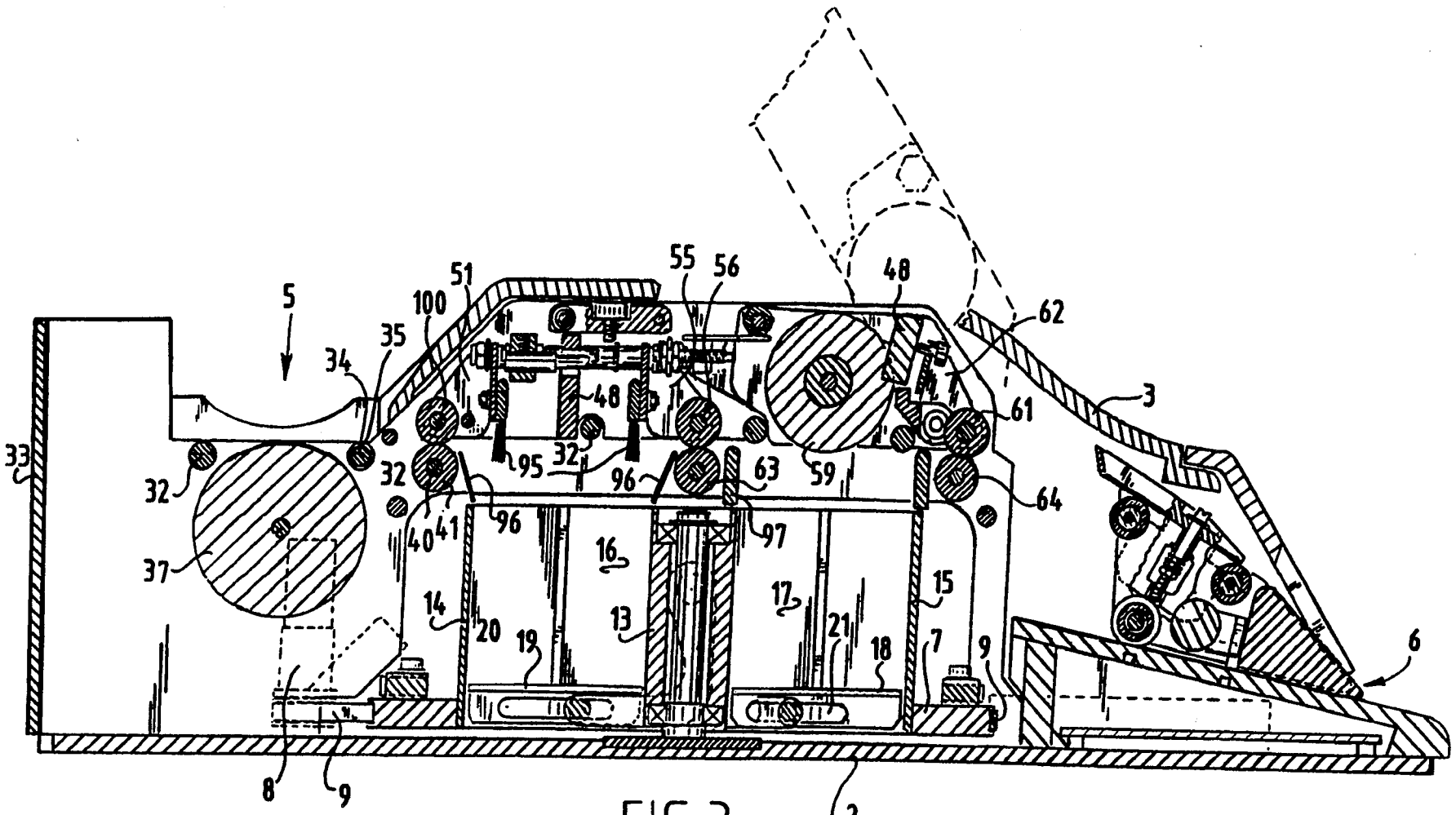
FIG. 3 shows a sectional view of the card shuffler according to the invention in the empty situation.

The microprocessor can be accommodated in diverse places in the device, for instance, as described with reference to FIG. 2, in the space adjacent to end wall 33. It is however also possible to accommodate the microprocessor or a part of the associated circuits in the space enclosed by the base plate 2 and the inclining plate 69, as shown in FIGS. 6 and 7 by a printed circuit board 91. It is otherwise possible to accommodate the microprocessor and the other electronic control components at other positions in the device.

The operation of the device according to the present invention will now be elucidated.

Point of departure is a starting situation, that is, a situation in which the machine is empty and the machine must initially be filled with cards before it can deliver shuffled playing cards.

By pressing the control button 92 on the control panel the machine is set into the filling position. A stack of cards 93 is subsequently placed in the feed compartment.

Figure 4:
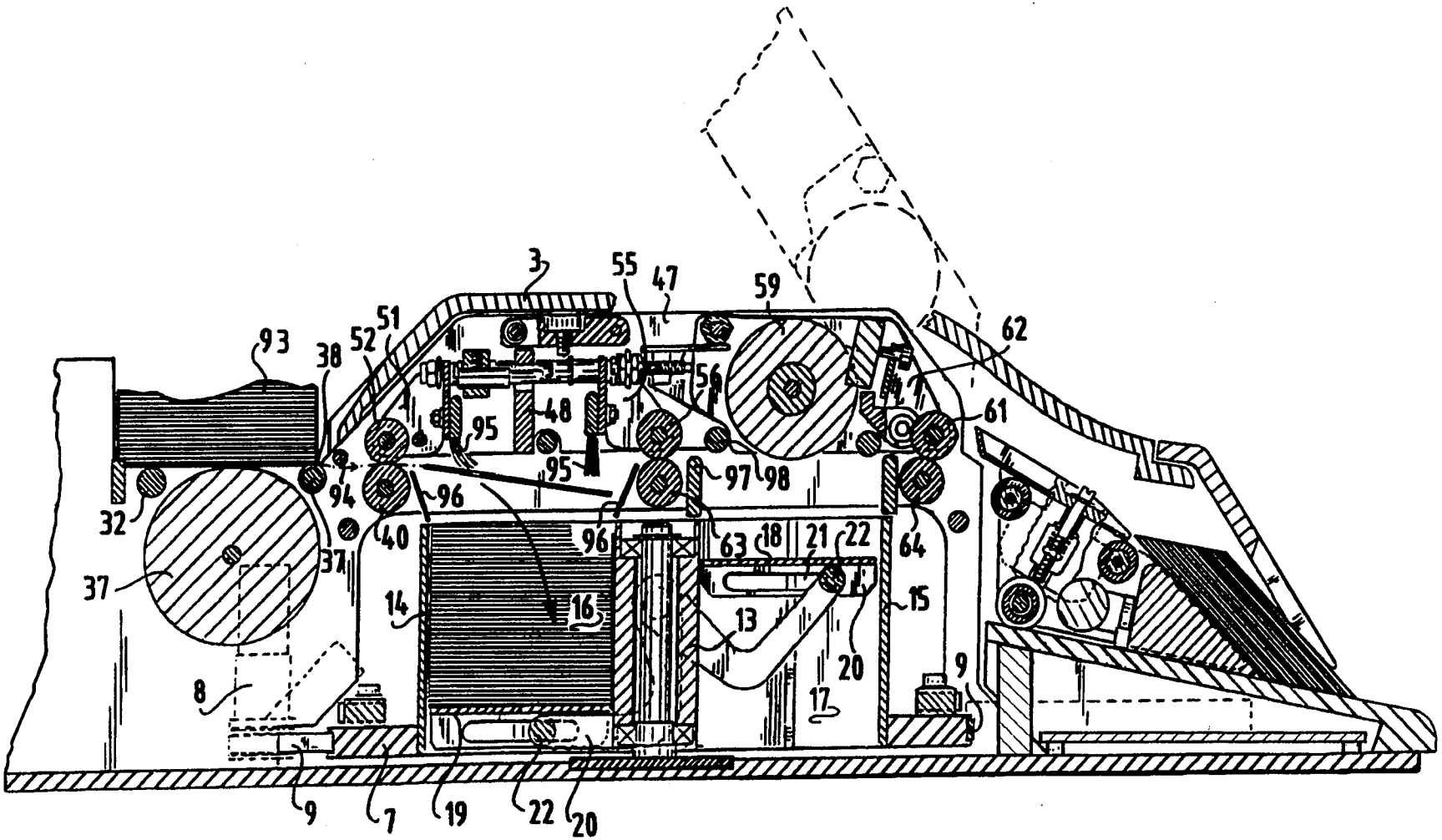
FIG. 4 shows a view corresponding with FIG. 3 in a partly filled situation.
Figure 5:
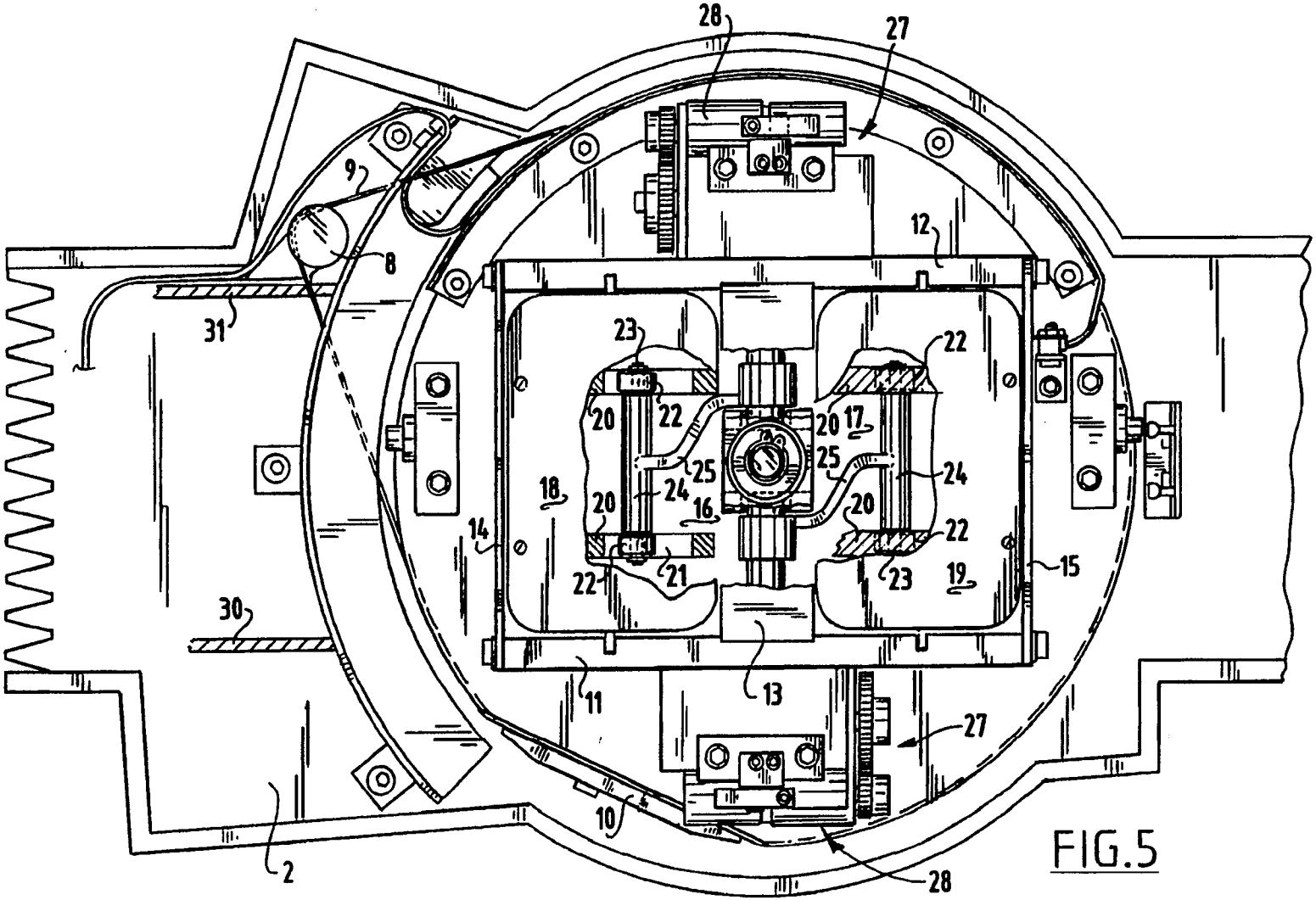
FIG. 5 is a partly broken away top view of the card shuffler according to the invention, wherein the cover is removed.

Such a situation is shown in FIG. 4. The control in the form of the microprocessor starts the drive motor 36 of drive disc 37 in addition to rollers 41, 100, wherein the cards 93 are gripped one by one on their underside, that is, on their picture side, by the drive disc 37 and will then be carried through the rollers 41, 100.

It is important herein that the drive disc 37 grips only a single card at a time. When this is not the case and more than one playing card at a time is transported, this is detected and relevant action is undertaken. It is of importance here that between the drive roller and the pinch between the carrier rollers 100, 41 a chicane is placed in the form of the shaft 34 with the discs 35 fixed thereto and a connecting rod 32. These elements functioning as guides ensure that the cards 93 are bent into a form such that an individual separation takes place and a possible second card adhering to the bottom card remains behind.

In order to prevent the card entering between rollers 56 and 63 as result of too high a speed in the pinch, a brush 95 is arranged which brakes the movement of the cards 93, as does a stop plate 96. It is noted herein that while the machine is in operation the carrier rollers 41, 63 and 64 are driven continuously.

The cards then fall one by one onto the base plate 19. The motor 28 herein ensures that the uppermost card always lies at the same level, so that, when the turntable is turned, this card can always be gripped by the drive disc 59 and the drop height of fed cards is constant.

This process is continued until a determined number of cards has fallen into the shuffling compartment, whereafter the drive motor of the turntable is activated and the other shuffling compartment 17 is filled with the same number of cards. The turntable is thereafter turned around and this process is continued until the total desired number of cards, for instance 150, is present in both shuffling compartments.

The actual shuffling process can then take place. The uppermost card in the shuffling compartment placed beneath drive roller 59 is gripped by the drive roller and, subject to a random signal generated by the microprocessor, is fed to the other shuffling compartment or supplied to the discharge means.

The motor 28 which is coupled to shuffling compartments in the first position ensures that the topmost card can be gripped by the drive disc 59.

The drive roller 59 will herein normally turn in clockwise direction, wherein the top card is thus gripped on its top side and fed through between rollers 56 and 63 to the shuffling compartment situated in the position designated with 16.

Use is also made here of a chicane in the form of a wall 97 and a cross connection 98. Use is additionally made herein of a stop plate 96 and brushes 95. At cards determined substantially by chance the rotation direction of drive roller 59 will be reversed and this will carry a card away to the side of the discharge device. In a normal situation the control will cause a card to be fed from the feed compartment each time a playing card is supplied to the discharge means. The number of cards in both shuffling compartments will thus be kept equal to the chosen number of for instance 150 cards.

The algorithm, which determines which card is supplied to the discharge card compartment instead of to the other card compartment, herein determines to a great extent the quality of the shuffling.

This process is continued until the discharge means, in this case the shoe 68, is entirely filled with playing cards, whereafter the relevant game can commence.

The machine then automatically enters the "play" mode, whereafter the normal shuffling process begins. This shuffling process corresponds with the above described filling process, with the understanding that, during the shuffling process, cards 93 are continuously present in one of both card compartments 16, 17 which are transferred to the other card compartment, wherein, determined by chance, a card is supplied to the discharge compartment 68. Each time this happens a card is carried from the feed compartment to one of the shuffling compartments 16, 17 in order to keep as equal as possible the number of cards circulating between the shuffling compartments, as during the filling process.

The control is further adapted such that one of a determined number of cards is always supplied to the discharge means. In addition to determining the quality of shuffling, this number is selected in accordance with the average take-off of playing cards per unit of time.

When, however, depending on the game situation, the "card consumption" is temporarily greater, the shoe may be in danger of becoming empty. The number of cards in the shoe is detected however and, when the shoe is in danger of emptying, more cards are supplied to the shoe 68. That is, of each smaller number of cards removed from the shuffling compartment present in the first position, a card is supplied to the shoe and a card is carried from the feed compartment to the shuffling compartment present in the second position. This prevents the game having to be stopped due to a lack of cards.

When, however, the feed compartment has emptied, the control is such that the shuffling process is continued temporarily in the card compartments 16 and 17 with a smaller number of cards, for instance 125. When at a later stage cards once again become available the number of cards is again supplemented to the original number.

When the machine is taken out of operation, it is of course possible to empty the machine, wherein all cards are carried from the shuffling compartments to the shoe.

Finally, the operation of the shoe, or discharge means will be considered.

As shown in FIG. 7, the cards are supplied between the rollers 64 and 61, whereafter the cards are bent by the guide plate 101 before they enter the guide channel 102. During transport through the guide channel 102 the cards are driven by the rollers 76, 77. The card then comes into contact with the stack of cards 99 already present, whereby the supplied card 93 undergoes a force whereby the carriage 70 is moved upward along the slope 69 and sufficient space becomes available behind the stack of cards 99 for interposing of the relevant card.

Due to the presence of the outlet opening 6 it is always easy to remove the foremost card by hand.

Although implementation of the control of the device is not described, a skilled person in the relevant field can deduce how the control can be embodied from the fact that a microprocessor is used and from the functional description.

It will be apparent that the above construction can be varied in diverse ways without going beyond the scope of the invention.

I claim:

1. Device for shuffling playing cards, comprising:

two shuffling card compartments which can each be placed in a first position and in a second position, a delivery compartment, transporting means for carrying the playing cards from the shuffling compartment located in the first position to the shuffling compartment located in the second position, discharge means for carrying playing cards from the card compartment located in the first position to the delivery compartment, control means for normally activating the transporting means and for otherwise activating the discharge means as determined by algorithm, feed means for feeding the playing cards for shuffling to one of the shuffling compartments.

2. Shuffling device as claimed in claim 1, characterized by means for exchanging the position of both shuffling compartments.

3. Shuffling device as claimed in claim 1 characterized in that the feed means comprise a feed compartment for receiving the playing cards for shuffling in addition to means for carrying playing cards from the feed compartment to the card compartment located in the second position.

4. Shuffling device as claimed in claim 3, characterized in that the control means are adapted for activating the feed means simultaneously with the activation of the discharge means at least for a part of the time of use.

5. Device as claimed in claim 1 characterized in that each of the card compartments is formed by four wall elements disposed in a rectangular pattern and extending substantially vertically, wherein the distance between mutually opposite wall elements is at least as large as the dimensions of the playing cards and that in each of the card compartments a base element is present which is movable in substantially vertical direction by means of a lifting electric motor and a lever transmission under the control of the control means.

6. Device as claimed in claim 5, characterized in that the control means are adapted for controlling the lifting electric motors such that the uppermost card present in the card compartment is situated at a predetermined level.

7. Device as claimed in claim 5 characterized in that the card compartments are both arranged on a plateau rotatable on a vertical shaft, which plateau is drivable in rotation by means of a rotation electric motor under the control of the control means.

8. Device as claimed in claim 1, characterized in that at least one of the transporting means and the discharging means comprises a gripping roller of large diameter placed above the first position and drivable in rotation which is adapted for gripping by means of friction on the upper side of the topmost playing card in the card compartment.

9. Device as claimed in claim 8, characterized in that the transporting means and the discharging means comprise the same gripping roller which during use as discharging means is drivable in a direction opposed to that during use as transporting means.

10. Device as claimed in claim 8, characterized in that the transporting means, the discharge means and the feed means each comprise a pair of rollers placed one above the other, at least one of which is drivable, and wherein the distance between the pinch of the pair of rollers and the gripping line of the gripping roller and the card for gripping is smaller in the intended transporting direction than the width of the playing card, wherein between the gripping roller and the pair of rollers a chicane is arranged.

11. Device as claimed in claim 1, characterized in that the feed means comprise a feeding compartment opened at the top which comprises on the underside a second gripping roller of large diameter which is adapted for gripping by means of friction on the underside of the bottommost playing card in the feeding compartment.

12. Device as claimed in claim 1, characterized in that of each pair of rollers the upper roller and the gripping roller forming part of the transporting means are fixed in a sub-frame tiltable upward on a horizontal shaft.

13. Device as claimed in claim 1, characterized in that the discharge means are adapted for supplying the shuffled playing cards to the side of the playing cards present in a delivery holder opposite to the side where the shuffled playing cards are removed from the stack.

14. Device as claimed in claim 13, characterized in that the delivery holder comprises a path inclining downward towards the take-off side, on which path a pressure body is movable for pressing on the stack of playing cards present in the delivery holder, and wherein the discharge means are adapted for moving the pressure body temporarily up the slope and placing a playing card between the pressure body and the stack of cards.

15. Device as claimed in claim 14, characterized in that the pressure body is provided with means for guiding and driving the playing cards.

16. Device as claimed in claim 15, characterized in that the guide means are adapted for bending the playing card after it leaves the pair of rollers forming part of the discharge means.

* * * * *